US007287466B2

(12) United States Patent
Hashimoto et al.

(10) Patent No.: US 7,287,466 B2
(45) **Date of Patent: *Oct. 30, 2007**

(54) STENCIL PRINTING MACHINE, INK RECOVERING METHOD, IMAGE UNEVENNESS PREVENTING METHOD, AND INK ADAPTING METHOD

(75) Inventors: Hirohide Hashimoto, Ibaraki-ken (JP); Taku Naitou, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/927,492

(22) Filed: Aug. 27, 2004

(65) Prior Publication Data

US 2005/0056169 A1 Mar. 17, 2005

(30) Foreign Application Priority Data

Aug. 29, 2003 (JP) ..... P2003-306291

(51) Int. Cl.
*B41F 15/40* (2006.01)
*B41F 15/38* (2006.01)
*B41L 13/06* (2006.01)

(52) U.S. Cl. ..... 101/119; 101/116

(58) Field of Classification Search ..... None
See application file for complete search history.

(56) References Cited

U.S. PATENT DOCUMENTS 6,263,791 B1 * 7/2001 Sato ..... 101/116
6,789,472 B2 * 9/2004 Nakamura et al. ..... 101/119
2004/0069164 A1 * 4/2004 Nakamura et al. ..... 101/119

FOREIGN PATENT DOCUMENTS

| | | | |
|---|---|---|---|
| GB | 2309195 A | * | 7/1997 |
| JP | 07047755 A | * | 2/1995 |
| JP | 07-132675 | | 5/1995 |
| JP | 08174984 A | * | 7/1996 |
| JP | 2001-246828 | | 9/2001 |
| JP | 2002-036704 | | 2/2002 |
| JP | 2002137523 A | * | 5/2002 |

OTHER PUBLICATIONS

Machine translation of JP 8-174984 to Kitano from Japanese Patent Office website.*

* cited by examiner

*Primary Examiner*—Daniel J. Colilla
(74) *Attorney, Agent, or Firm*—The Nath Law Group; Jerald L. Meyer; Matthew J. Moffa

(57) ABSTRACT

A stencil printing machine has a rotatable printing drum including an outer peripheral wall of ink impermeable material. A stencil paper is mounted on the surface of the outer peripheral wall. An ink supplying mechanism includes an ink supplying unit in the outer peripheral wall of the printing drum. The ink supplying mechanism supplies ink from the ink supplying unit to the surface of the outer peripheral wall. A pressure roller presses a fed print sheet against the outer peripheral wall. An ink recovering mechanism recovers ink which has flown out of a maximum printing area of the outer peripheral wall of the printing drum. A pressing mechanism presses the stencil paper against the outer peripheral wall of the printing drum.

15 Claims, 12 Drawing Sheets

STENCIL PRINTING MACHINE, INK RECOVERING METHOD, IMAGE UNEVENNESS PREVENTING METHOD, AND INK ADAPTING METHOD

BACKGROUND OF THE INVENTION

1. Field of the Invention

The present invention relates to a stencil printing machine which transfers ink, transuding out of pores in a stencil paper, to a print medium by transferring the print medium while pressing the print medium against a printing drum on which the stencil paper is mounted; an ink recovering method; an image unevenness preventing method; and an ink adapting method.

2. Description of the Related Art

As conventional stencil printing machines of this type, there have been an inner press type (disclosed in Japanese Patent Application Laid-open No. 7-132675) and an outer press type (disclosed in Japanese Patent Application Laid-open No. 2001-246828).

The inner press type will be explained briefly as follows. The inner press type is provided with a printing drum and a back press roller whose diameters are nearly equal. The printing drum and the back press roller are arranged so as to be each capable of being rotated in a state that parts of each of the outer peripheral surfaces of the printing drum and the back press roller are made closely adjacent to each other. The printing drum, whose outer peripheral wall is flexible, is formed of an ink permeable screen. The printing drum is provided, inside the outer peripheral surface, with an ink supplying mechanism which supplies ink to the inner surface of the screen, and which can press the inner surface of the screen by an inner pressure roller.

Then, the printing drum on which a stencil paper is mounted and the back press roller are caused to be rotated while being synchronized with each other. A print sheet is fed between the rotated printing drum and the rotated back press roller. Thence, the inner press roller presses the screen. By the pressing, the print sheet is transferred between the back press roller and the stencil paper while being pressed against, and brought into contact with, the back press roller and the stencil paper. In the process of this transfer, ink on the side of the screen is transferred, out of pores in the stencil paper, onto the print sheet. Accordingly, an image is printed onto the print sheet.

In addition, the outer press type will be described briefly as follows. The outer press type is provided with a printing drum. The outer peripheral wall of the printing drum is formed of a porous, ink permeable member. The printing drum is provided, inside, with an ink supplying mechanism which supplies ink to the ink permeable member, and outside, with a pressure roller.

Then, the printing drum on which a stencil paper is mounted is caused to be rotated, and a print sheet is fed between the rotated printing drum and the rotated presser roller. Thence, the pressure roller presses the printing drum. By the pressing, the print sheet is transferred between the pressure roller and the stencil paper while being pressed against, and brought into contact with, the pressure roller and the stencil paper. In the process of this transfer, ink on the side of the printing drum is transferred, out of pores in the stencil paper, onto the print sheet. Accordingly, an image is printed onto the print sheet.

With regard to each of the above-described, conventional, inner and outer press types of stencil printing machines, however, an ink pool is formed in the ink supplying mechanism located inside the printing drum, and ink in the ink pool is supplied to the printing drum in the course of a printing operation. Consequently, when the printing is not performed for a long time, ink held in the ink pool and ink staining in the printing drum are left in a state of being exposed to the atmosphere for a long time. This causes a problem of the ink being changed in quality.

In addition, since various rollers for supplying ink have to be arranged inside the printing drum, this causes a problem of making it difficult to miniaturize, and to reduce the weight of, the printing drum.

Against this background, the applicant of the present invention has developed a stencil printing machine comprising: a printing drum, which is capable of being rotated, which includes an outer peripheral wall formed of ink impermeable material, and on which a stencil paper is mounted around the surface of the outer peripheral wall; an ink supplying mechanism, which includes an ink supplying unit in a printed place upstream of the maximum printing area of the outer peripheral wall of the printing drum, and which supplies ink from the ink supplying unit to the surface of the outer peripheral wall; a pressure roller which presses the fed print medium against the surface of the outer peripheral wall; and an ink recovering mechanism which recovers ink that has flown out of the maximum printing area of the outer peripheral wall of the printing drum.

In this stencil printing machine, when the outer peripheral wall is caused to be rotated and a print medium is fed in a state that ink is supplied from the ink supplying unit to the surface of the outer peripheral wall, this print medium is transferred while being pressed against the stencil paper and the outer peripheral wall of the printing drum by the pressure roller. Concurrently, ink between the outer peripheral wall of the printing drum and the stencil paper is caused, by the pressure of the pressure roller, to be spread downstream in the printing direction while being squeezed through in-between. In addition, the spread ink transudes out of pores in the stencil paper, and is transferred onto the print medium, whereby an image is printed onto the print medium. Ink which has been supplied to the printing drum is held in a virtually airtight space between the outer peripheral wall of the printing drum and the stencil paper, and the exposure of the ink to the atmosphere is minimized. Furthermore, various rollers for supplying ink need not be arranged in the interior of the printing drum. As a consequence, ink will not be changed in quality even when the printing is not performed for a long time. Thus, the printing drum can be miniaturized, and the weight can be reduced.

It should be noted that, even in this stencil printing machine, much ink conglutinates to a used stencil paper which has been taken off the printing drum. For this reason, when the used stencil paper is scrapped as it is, the ratio of an amount of actually used ink to an amount of supplied ink is so small as to be uneconomical. Against this background, an ink recovering mechanism of recovering ink staining in the stencil paper has been heretofore proposed (disclosed in Japanese Patent Application Laid-open No. 2002-36704). This ink recovering mechanism can be applied to the stencil printing machine.

This ink recovering mechanism comprises: an ink scraping device of scraping ink, staining in the stencil paper which has been taken off the printing drum, off the stencil paper; and an ink returning device of returning the ink, scraped off by the ink scraping device, to the printing drum.

However, the above described ink recovering mechanism takes so complicated a constitution that a number of components are needed. Moreover, ink remains staining in the ink scraping device and the ink returning device in the process of scraping ink off the stencil paper and returning the ink scraped off. This causes a problem of lowering the recycling ratio.

In addition, with regard to a printed sheet prepared by the stencil printing machine, when there is a solid area thereon, a place with a high concentration is caused in the edge of a printed place downstream of the solid area. Consequently, unevenness of the concentration is wished to be prevented.

SUMMARY OF THE INVENTION

An object of the present invention is to provide a stencil printing machine, an ink recovering method, an image unevenness preventing method, which can recover ink by using a simple configuration and with a higher ratio of recycling ink.

In addition, another object of the present invention is to provide a stencil printing machine, and an image unevenness preventing method, and an ink adapting method, which can prevent unevenness of concentration from being caused in a solid area on a printed sheet.

To attain the above described objects, a first aspect of the present invention provides a stencil printing machine comprising: a rotatable printing drum including an outer peripheral wall of ink impermeable member, wherein a stencil paper is mounted on the surface of the outer peripheral wall; an ink supplying mechanism including an ink supplying unit in the outer peripheral wall of the printing drum, configured to supply ink from the ink supplying unit to the surface of the outer peripheral wall; a pressure roller configured to press a fed print medium against the outer peripheral wall; an ink recovering mechanism configured to recover ink which has flown out of a maximum printing area of the outer peripheral wall of the printing drum; and a pressing mechanism configured to press the stencil paper against the outer peripheral wall of the printing drum.

In this stencil printing machine, for instance, when an operation of discharging a stencil paper is chosen, the pressing mechanism causes the outer peripheral wall to be rotated while pressing the stencil paper against the outer peripheral wall, whereby ink between the stencil paper and the outer peripheral wall is squeezed through in-between, and is collected in a printed place downstream of the maximum printing area. The collected ink is recovered by the ink recovering mechanism. Accordingly, a mere addition of the pressing mechanism for pressing the stencil paper serves for the object of the present invention. In addition, ink rarely remains staining in the pressing mechanism which is not a usual route of ink circulation, although ink remains in a usual route of ink circulation including the ink supplying unit, the outer peripheral wall and the ink recovering mechanism.

In addition, for instance, in the course of an printing operation, when the printing operation is performed in a way that the print medium is transferred between the pressure roller and the outer peripheral wall of the printing drum by being pressed against, and brought into contact with, the pressure roller and the outer peripheral wall while the stencil paper is pressed against the outer peripheral wall by the pressing mechanism, an air bubble, if formed between the stencil paper and the outer peripheral wall, is squeezed out by the pressing mechanism. Accordingly, ink is transferred onto the print medium as if in a state that the air bubble did not exist in the inner surface of the stencil paper. As a consequence, an image unevenness which an excessive amount of transferred ink would otherwise cause does not occur in the end of a printed place downstream of a solid area.

The above described pressing mechanism serves for the object of the present invention even if the pressing mechanism is caused to press the stencil paper against the outer peripheral wall while an operation of discharging a stencil paper is being performed. In this stencil printing machine, when the operation of discharging a stencil paper is chosen, as described above, ink between the stencil paper and the outer peripheral wall is collected in a printed place downstream of the maximum printing area. Then the ink is recovered by the ink recovering mechanism.

The above described pressing mechanism serves for the object of the present invention even if the pressing mechanism is caused to press the stencil paper against the outer peripheral wall while a printing operation is being performed. In this stencil printing machine, when a printing operation is chosen, as described above, an air bubble between the stencil paper and the outer peripheral wall is squeezed out. Accordingly, the printing operation is carried out as if in a state that the air bubble did not exist in the inner surface of the stencil paper.

The above described pressing mechanism serves for the object of the present invention even if the pressing mechanism is caused to press the stencil paper against the outer peripheral wall while an operation of mounting a stencil paper on the printing drum is performed. In this stencil printing machine, ink which is supplied from the ink supplying unit spreads over the stencil paper by supplying ink and by pressing the stencil paper against the outer peripheral wall at the same time that the stencil paper is mounted on the printing drum.

The pressing body of the pressing mechanism may comprise a roller which is supported so as to be rotatable. In this stencil printing machine, stress cast on the stencil paper can be relieved.

It is preferable that the pressing body of the pressing mechanism is formed of a material which is not easily soaked with ink. In the stencil printing machine, ink rarely conglutinates to the pressing body.

The above described pressure roller can be used as the pressing body. In this stencil printing machine, the constitution will be made simpler, since no pressing body but the pressure roller needs to be added. A specific operation is as follows: ink is collected in a printed place downstream of the maximum printing area by the pressing of the stencil paper by the pressure roller, when an operation of discharging a stencil paper is chosen. In addition, when a printing operation is performed, the stencil printing machine alternates an operation of squeezing out an air babble by the pressing of the stencil paper by the pressure roller with an operation of applying pressure onto a print medium by the pressure roller.

A second aspect of the present invention is to provide a method for recovering ink, which is used in the stencil printing machine. The method for recovering ink causes an outer peripheral wall to be rotated while a stencil paper is pressed against an outer peripheral wall by a pressing mechanism, causes ink, which is between the stencil paper and the outer peripheral wall, to move, and recovers ink which has flown out of the maximum printing area of the outer peripheral wall.

In this ink recovering method, ink between the stencil paper and the outer peripheral wall is collected downstream of the maximum printing area, and is recovered by the ink recovering mechanism. By this ink recovering method, a mere addition of the pressing mechanism for pressing the stencil paper serves for the object of the present invention. In addition, ink rarely remains staining in the pressing mechanism which is not a usual route of ink circulation, although ink remains staining in a usual route of ink circulation including the ink supplying unit, the outer peripheral wall, and the ink recovering mechanism.

In the above described ink recovering method, when an operation of disposing a stencil paper is chosen, the recovering of ink serves for the object of the present invention, if the recovering of ink is performed by rotating the outer peripheral wall while pressing the stencil paper against the outer peripheral wall by the pressing mechanism. By this ink recovering method, ink could be recovered before the stencil paper is discharged.

In the above described ink recovering method, immediately after a series of printing operations is completed, the recovering of ink serves for the object of the present invention, if the recovering of ink is performed by rotating the outer peripheral wall while pressing the stencil paper against the outer peripheral wall by the pressing mechanism. By this ink recovering method, a ratio of recycling ink could be improved, since ink in the inner surface of the stencil paper has not yet be evaporated or reduced its volume immediately after the printing operations are completed.

Furthermore, in the above described ink recovering method, when the power supply is chosen to be off, the recovering of ink serves for the object of the present invention, if the recovering of ink is performed by rotating the outer peripheral wall while pressing the stencil paper against the outer peripheral wall by the pressing mechanism. By this ink recovering method, ink remaining in the inner surface of the stencil paper could be securely prevented from disappearing through evaporation and the like, from a time when the power supply is turned off until a time when the power supply is turned on again.

A third aspect of the present invention is to provide an image unevenness preventing method of the stencil printing machine. The image unevenness preventing method performs a printing operation in a state of causing a pressing mechanism to press a stencil paper against the outer peripheral wall by a pressing mechanism when a printing operation is performed.

In this image unevenness preventing method, an air bubble, if formed between the stencil paper and the outer peripheral wall, is squeezed out by the pressing mechanism. Accordingly, ink is transferred onto the print medium as if in a state that the air bubble did not exist in the inner surface of the stencil paper. As a consequence, an image unevenness, which an excessive amount of transferred ink would otherwise cause, does not occur in the end of a printed place downstream of a solid area.

A fourth aspect of the present invention is to provide an ink adapting method of the stencil printing machine. An ink adapting method presses the stencil paper against the outer peripheral wall by a pressing mechanism while ink is supplied from an ink supplying unit in the course of an operation of mounting the stencil paper on the printing drum.

This ink adapting method would cause ink, which is supplied to an ink supplying unit, to spread over the entire stencil paper by supplying ink, and by pressing the stencil paper, at the same time that the stencil paper is mounted on the printing drum.

DETAILED DESCRIPTION OF THE PREFERRED EMBODIMENT

An embodiment of the present invention will be described hereinafter with reference to the accompanying drawings.

Figure 1:
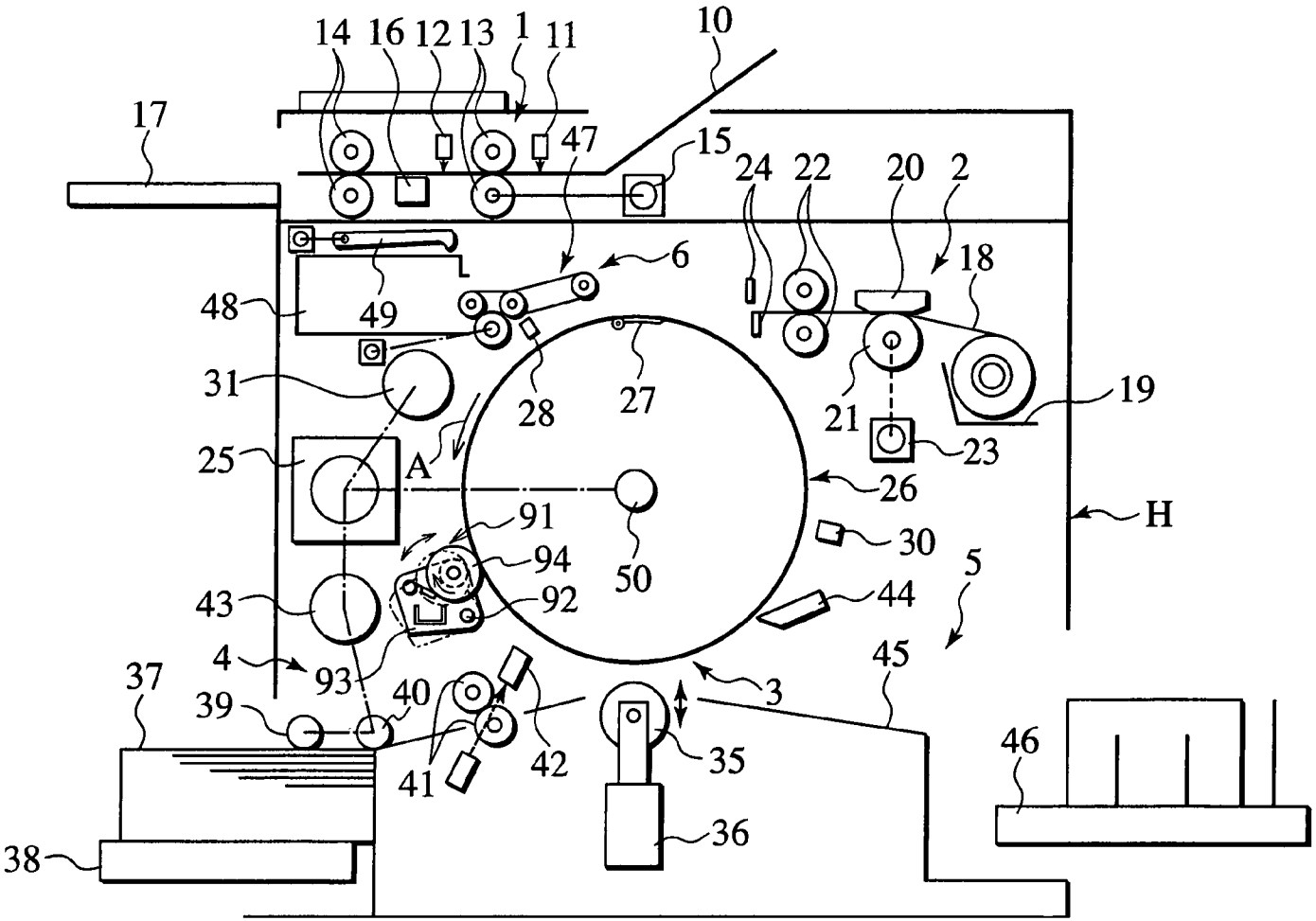
FIG. 1 is a schematic block diagram of a stencil printing machine to show an embodiment of the present invention.

As shown in FIG. 1, a stencil printing machine is provided with an original scanning unit 1, a stencil making unit 2, a printing unit 3, a paper feeding unit 4, a paper discharging unit 5, and a stencil discharging unit 6.

The original scanning unit 1 comprises: an original setup rack 10 on which an original to be printed is loaded; original detection sensors of a reflective type 11 and 12 for checking whether or not the original is on the original setup rack 10; original leading rollers 13 and 14 for transferring the original which has been loaded on the setup rack 10; a stepping motor 15 for causing the original leading rollers 13 and 14 to be driven and rotated; an image sensor of contact type 16 for optically scanning image data of the original to be transferred by the original leading rollers 13 and 14, and for converting the image data into electric signals; and an original discharging tray 17 on which an original to be discharged from the original setup rack 10 is loaded. In addition, the original which has been loaded on the original setup rack 10 is transferred by the original leading rollers 13 and 14, and the image data of the original thus transferred is acquired by the image sensor 16.

The stencil making unit 2 comprises: an original containing unit 19 which contains a roll of a long stencil paper 18; a thermal print head 20 which is arranged downstream of transferring from the original containing unit 19; a platen roller 21 which is arranged in a place opposite to the thermal print head 20; a pair of stencil transferring rollers 22 and 22 which are arranged downstream of transferring from the platen roller 21 and the thermal print head 20; a light pulse motor 23 for causing the platen roller 21 and the pair of stencil transferring rollers 22 and 22 to be driven and rotated; and a stencil cutter 24 which is arranged downstream of transferring from the pair of stencil transferring rollers 22 and 22.

In addition, the long stencil paper 18 is transferred by the rotations of the platen roller 21 and the stencil transferring rollers 22 and 22, and the stencil paper 18 is perforated according to heat sensitiveness in a way that each of dotted heat generators of the thermal print head 20 performs a selective operation of generating heat based on the image data acquired by the image sensor 16. Accordingly, a stencil paper 18 is made. The stencil paper 18 thus made is cut, by a stencil cutter 24, into a stencil paper 18 of a prescribed length.

The printing unit 3 comprises: a printing drum 26 which is caused by a driving force of a main motor 25 to be rotated in the direction indicated by an arrow A in FIG. 1; a stencil clamping unit 27, installed onto the outer peripheral surface of the printing drum, for clamping the edge of the stencil paper 18; a stencil loading sensor 28 for checking whether or not the stencil paper 18 is wound around, and mounted on, the outer peripheral surface of the printing drum 26; a reference position detecting senor 30 for detecting the reference position of the printing drum 26; and a rotary encoder 31 for detecting the revolution of the main motor 25. The rotating position of the printing drum 26 is configured to be enabled to be detected by detecting an output pulse of the rotary encoder 31 based on an output detected by the reference position detecting sensor 30.

Further, the printing unit 3 comprises a pressure roller 35 which is arranged in a place below the printing drum 26. The pressure roller 35 is configured to be capable of providing displacement between a pressing position where the pressure roller is pressed against the outer peripheral surface of the printing drum 26 by a driving force caused by a solenoid device 36 and a resting position where the pressure roller is separated away from the outer peripheral surface of the printing drum 26. The pressure roller 35 is always positioned in the pressing position during the period of being in a printing mode (including a trial print mode), and is positioned in the resting position during the period of being in a mode other than the printing mode.

The edge of the stencil paper 18 to be transferred from the stencil making unit 2 is clamped by the stencil clamping unit 27, and the stencil paper 18 is wound around, and mounted on, the outer peripheral surface of the printing drum 26 by rotating the printing drum 26 in a state that the edge of the stencil paper is clamped. Afterwards, the print sheet 37 (i.e. a print medium) to be fed from the paper feeding unit 4 while being synchronized with the rotation of the printing drum 26 is pressed by the pressure roller 35 against the stencil paper 18 which has been wound around the printing drum 26. By this, an image is printed in a way that ink 56 out of the pores in the stencil paper 18 is transferred onto the print sheet 37.

The paper feeding unit 4 comprises: a paper feed tray 38 on which print sheets 37 are laid in a stack; primary paper feeding rollers 39 and 40 which feed from the paper feed tray 38 only a print sheet 37 which is located at the top of the stack; a pair of secondary paper feeding roller 41 and 41 that feeds the print sheet 37, which has been fed by the primary paper feeding rollers 39 and 40, between the printing drum 26 and the pressure roller 35 while being synchronized with the rotation of the printing drum 26; and a paper detection sensor 42 for checking whether or not the print sheet 37 has been fed between the pair of secondary paper feeding rollers 41 and 41. The primary paper feeding rollers 39 and 40 are configured in a way that the revolution of the main motor 25 is selectively transmitted to the primary paper feeding rollers 39 and 40 through a paper feeding clutch 43.

The paper discharging unit 5 comprises: a paper separator 44 for separating a print sheet 37, which has been processed for printing, from the printing drum 26; a transferring passage 45 in which the print sheet 37 which has been separated away from the printing drum 26 by the paper separator 44 is transferred; and a paper receiving tray 46 on which the print sheet 37 that has been discharged from the transferring passage 45 is fed.

The stencil discharging unit 6 comprises: a discharged stencil transferring mechanism 47 for guiding the edge of the stencil paper 18, which has been released from a state of being clamped to the outer peripheral surface of the printing drum 26, and for transferring the used stencil paper thus guided while separating the used stencil paper from the printing drum 26; a stencil disposal box 48 for containing the stencil paper 18 which has been transferred by the discharged stencil transferring mechanism 47; and a discharged stencil paper compressing member 49 for pressing into the back of the stencil disposal box 48 the stencil paper 18 which has been transferred to the inside of the stencil disposal box 48 by the discharged stencil transferring mechanism 47.

Figure 2:
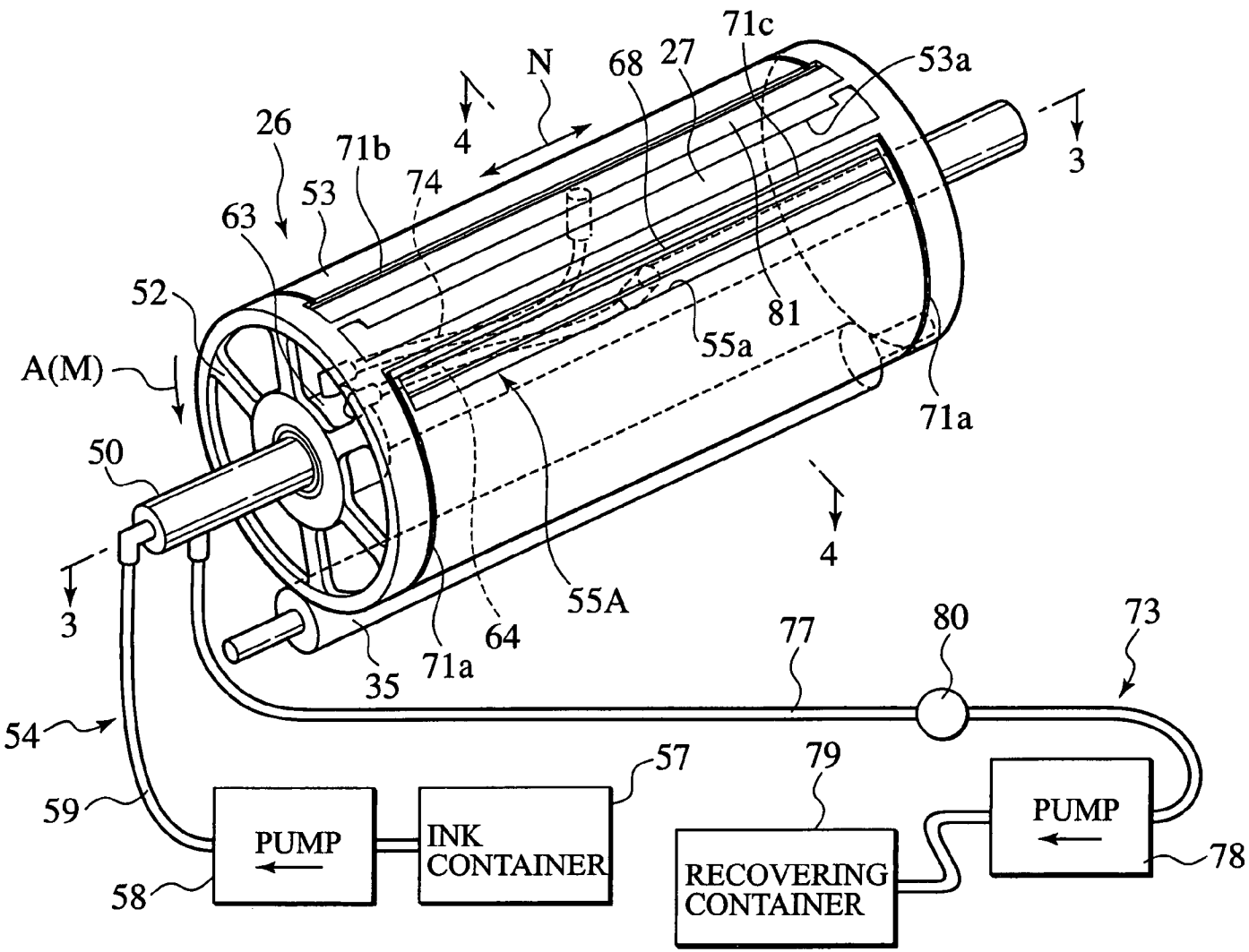
FIG. 2 is a perspective view of a printing drum, omitting a pressing mechanism, to show the embodiment of the present invention.
Figure 3:
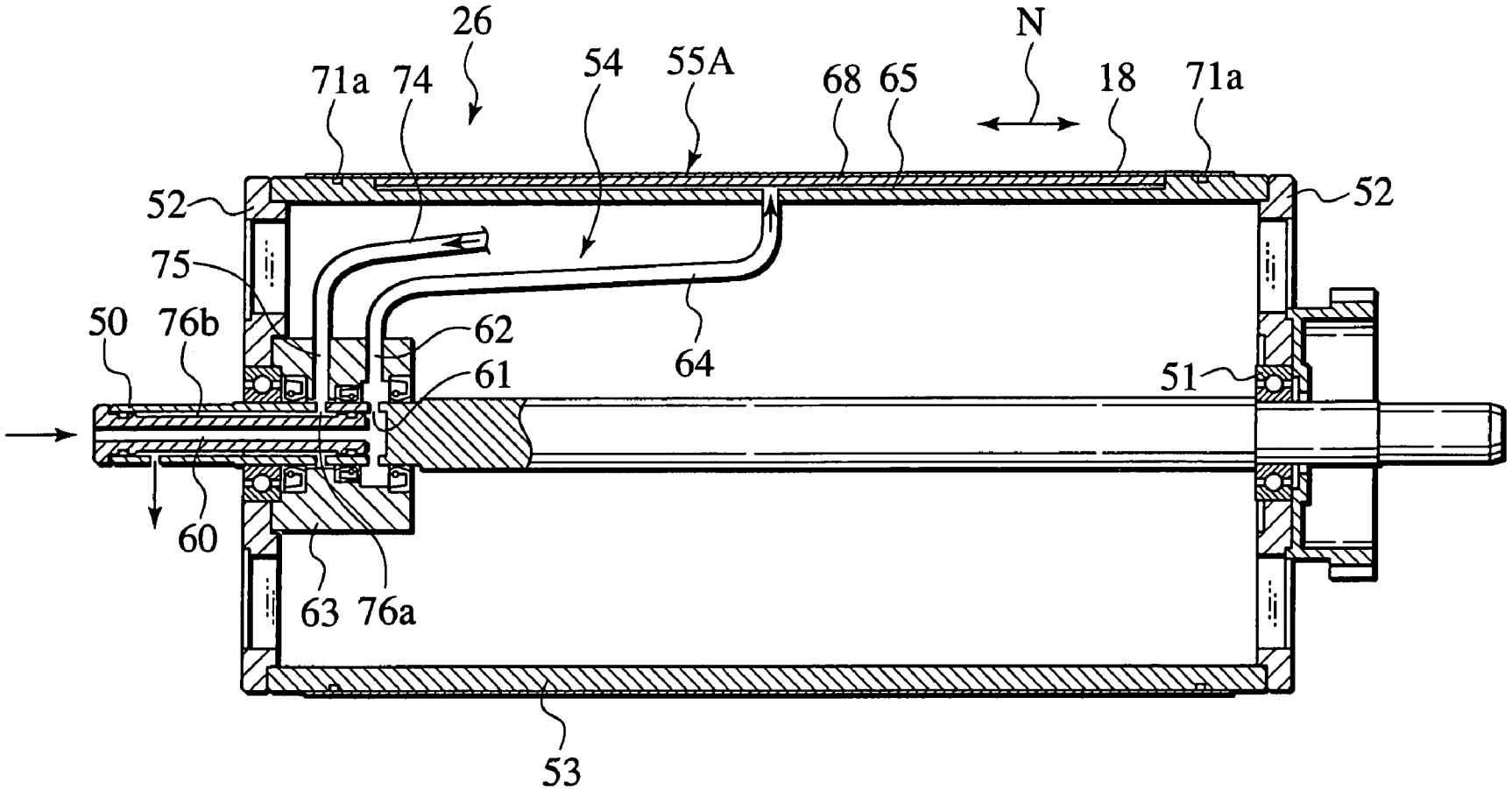
FIG. 3 is a cross sectional view taken along the 3-3 line of FIG. 2 to show the embodiment of the present invention.
Figure 4:
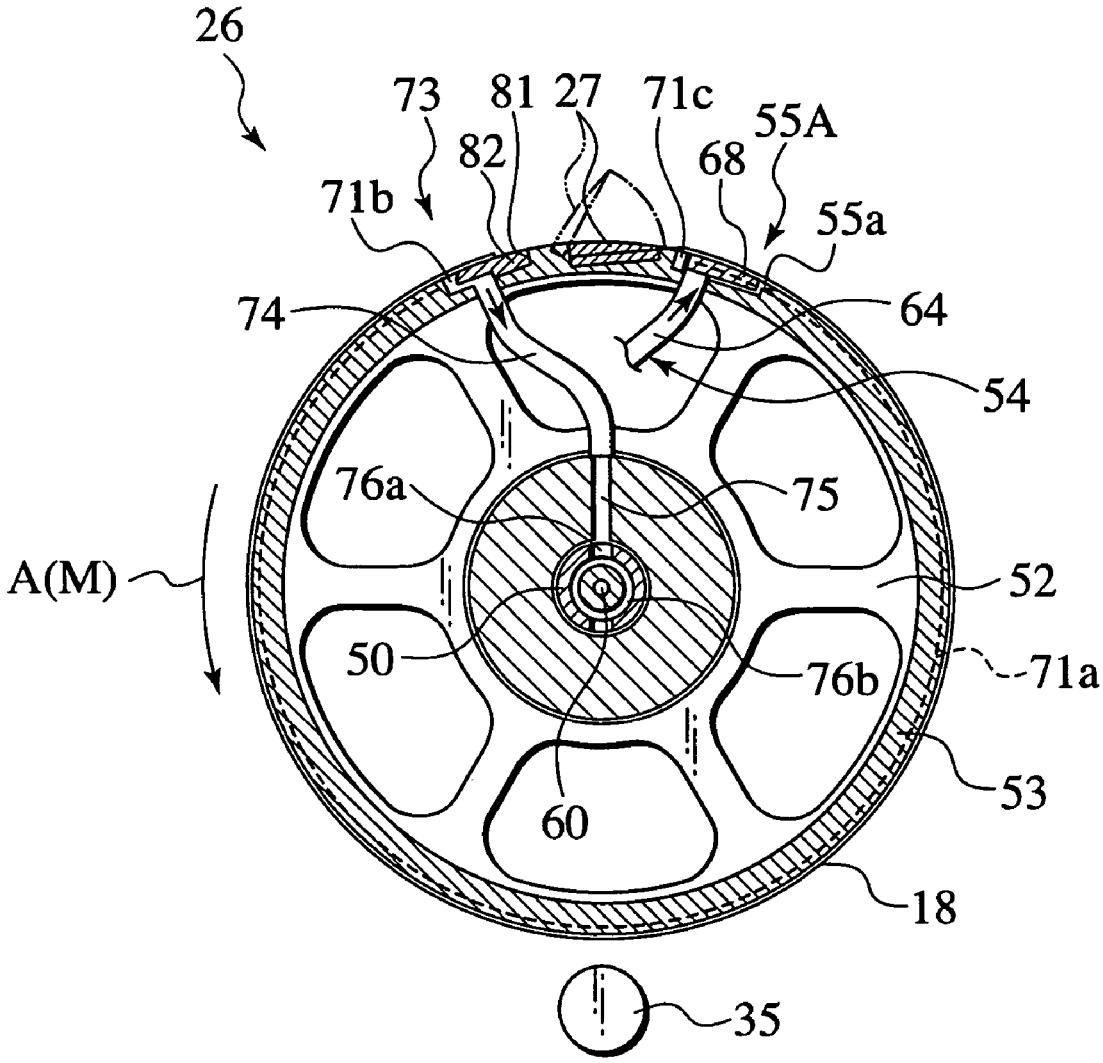
FIG. 4 is a cross sectional view taken along the 4-4 line of FIG. 2 to show the embodiment of the present invention.

As shown in FIG. 2 to FIG. 4, the printing drum 26 comprises: a main shaft 50 which is fixed to the main body H of the stencil printing machine (illustrated in FIG. 1); a pair of side discs 52 and 52 which are supported by the main shaft 50 so as to be capable of being rotated while respectively riding on bearings 51; and an outer peripheral wall 53, shaped like a cylinder, which is fixed in-between the pair of side discs 52 and 52. This outer peripheral wall 53 is configured to be integrated with the pair of side discs 52 and 52, and to be driven and rotated by a revolving force of the main motor 25. In addition, the outer peripheral wall 53 is formed of ink impermeable material which is rigid, and which does not allow ink 56 to permeate through. Furthermore, the outer peripheral surface of the outer peripheral wall 53 is coated with Teflon (a registered trade mark), and is formed into a cylindrical surface without dents or protrusions.

The stencil clamping unit 27 is provided to a concave portion 53*a* for the clamping, which is formed in the axial direction of the main shaft 50 of the outer peripheral wall 53. With regard to the stencil clamping unit 27, one end thereof is supported by the outer peripheral wall 53 so as to be capable of being rotated, and projects from the outer peripheral wall 53 while being released from a state of being clamped, which is indicated with imaginary lines in FIG. 4. The end is configured so that the end does not stick out of the outer peripheral wall 53 while in a state of being clamped, which is indicated with solid lines in FIG. 4. As a consequence, the stencil clamping unit 27 is configured so that the stencil clamping unit can clamp the stencil paper 18 without sticking out of the outer peripheral wall 53.

This outer peripheral wall 53 is caused to be rotated in the direction indicated with an arrow A(M) in FIG. 2 and FIG. 4, and a position where the outer peripheral wall rotates a little away from the stencil clamping unit 27 is defined as the point from which the printing is started. Accordingly, the direction A of the rotation becomes equivalent to the direction M of the printing, and an area below the point from which the printing is started is assigned as a printing area. In this embodiment of the present invention, the maximum printing area is set up in an area in which an A3 sized sheet can be printed. In addition, an ink supplying unit 55A of an ink supplying mechanism 54 is provided to a place upstream of the maximum printing area in the direction M of the printing.

A shown in FIG. 2 to FIG. 5, the ink supplying mechanism 54 comprises: an ink container 57 for containing ink 56; an ink pump 58 for sucking up the ink 56 which is contained in the ink container 57; a first pipe 59 for supplying the ink 56 which has been sucked up by the ink pump 58; the main shaft 50, which one end of the first pipe 59 is connected to, which an ink passage 60 is formed in, and where a hole 61 is formed in a place diametrically opposite; a rotary joint 63, which is supported by the outer periphery of the main shaft 50 so as to be capable of being rotated, and where a communicating hole 62 that can communicate with the hole 61 is formed; a second pipe 64, one end of which is connected to the rotary joint 63, and the other end of which is guided to the outer peripheral wall 53; and an ink supplying unit 55A to which the other end of the second pipe 64 is open. The ink passage 60, the hole 61, 62 and the second pipe 64 constitute a conduit for supplying ink to the ink supplying unit 55A from the inside of the printing drum 26 without exposing the ink to the atmosphere. The ink supplying unit 55A is configured to supply ink from the second pipe 64 into a space between the stencil paper 18 and the outer peripheral wall 53 of the printing drum 26 without exposing the ink to the atmosphere.

Figure 6:
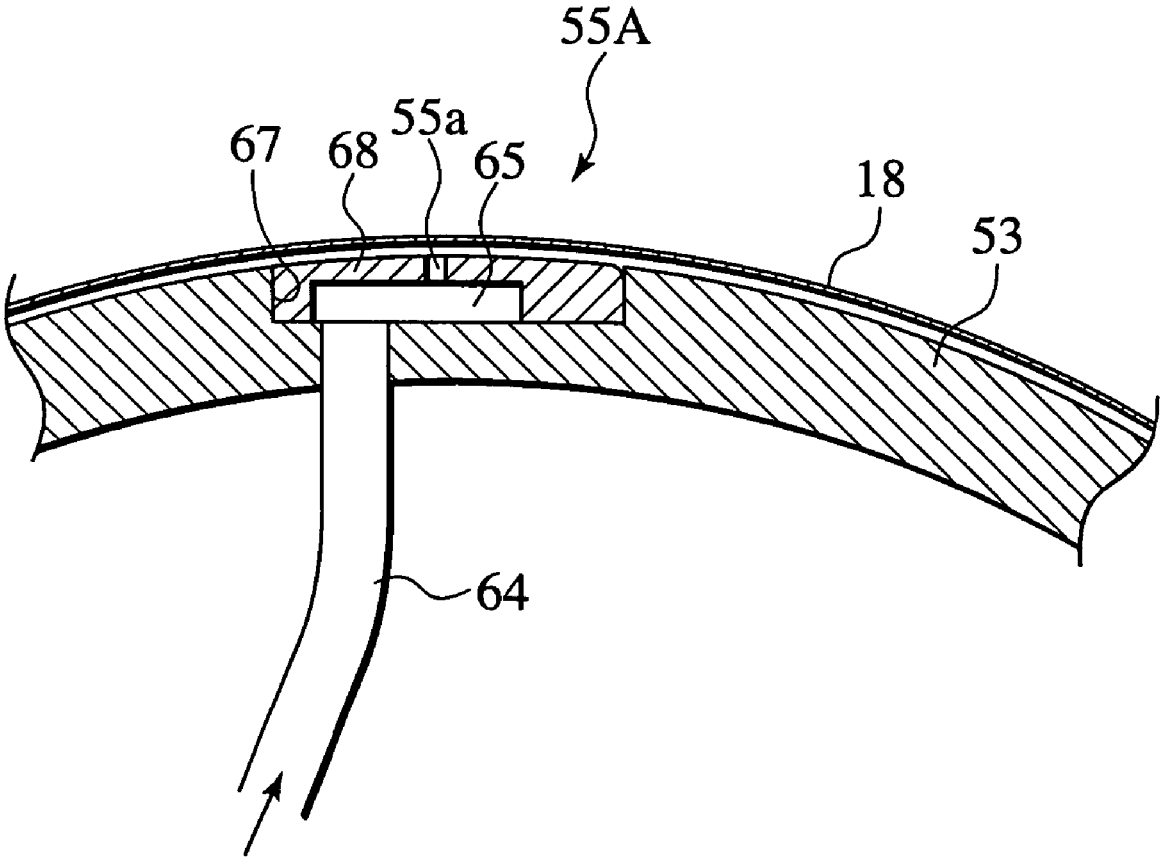
FIG. 6 is magnified, cross sectional view of the vicinity of an ink supplying unit to show the embodiment of the present invention.

The ink supplying unit 55A comprises: an ink dispersing groove 65 (illustrated in FIG. 6) for dispersing the ink 56 (illustrated in FIG. 9), which comes from the second pipe 64, in the direction N orthogonal to the printing direction M; an ink supplying outlet 55*a*, one end of which is open in a place at a distance away from the ink dispersing groove 65 and in the direction N orthogonal to the printing direction M, and the other end of which is open to the surface of the outer peripheral wall 53. The ink dispersing groove 65 and the ink supplying outlet 55*a* are formed so that an ink distributing member 68 is arranged in an concave portion which is formed in the outer peripheral wall 53 in the direction N orthogonal to the printing direction M. The ink supplying outlets 55*a* are arrayed on a straight line in the direction N orthogonal to the printing direction M, and supplies the ink 56 almost evenly in the direction N orthogonal to the printing direction M on the outer peripheral wall 53.

As shown in FIG. 2 to FIG. 5, an ink recovering mechanism 73 comprises: ink leakage preventing grooves (ink recovering grooves) 71*a*, 71*b* and 71*c* which are arranged, as if the sides of a rectangle, throughout the outer periphery of the maximum printing area S of the outer peripheral wall 53; a third pipe 74, one end of which is open to the ink leakage preventing groove 71*b*; the rotary joint 63, which the other end of the third pipe 74 is connected to, and which a communicating hole 75 is formed in; the main shaft 50, by which the rotary joint 63 is supported so as to be capable of being rotated, where a hole 76*a* with which the communicating hole 75 can communicate is formed, and in whose interior an ink passage 76*b* is formed; a fourth pipe 77, one end of which is connected to the main shaft 50; an ink pump 78 (e.g. a trochoid pump), which is placed in the middle of the fourth pipe 77, and which sucks up the ink 56 which stays in the fourth pipe 77; and a recovering container 79, to which the other end of the fourth pipe 77 is connected.

Figure 5:
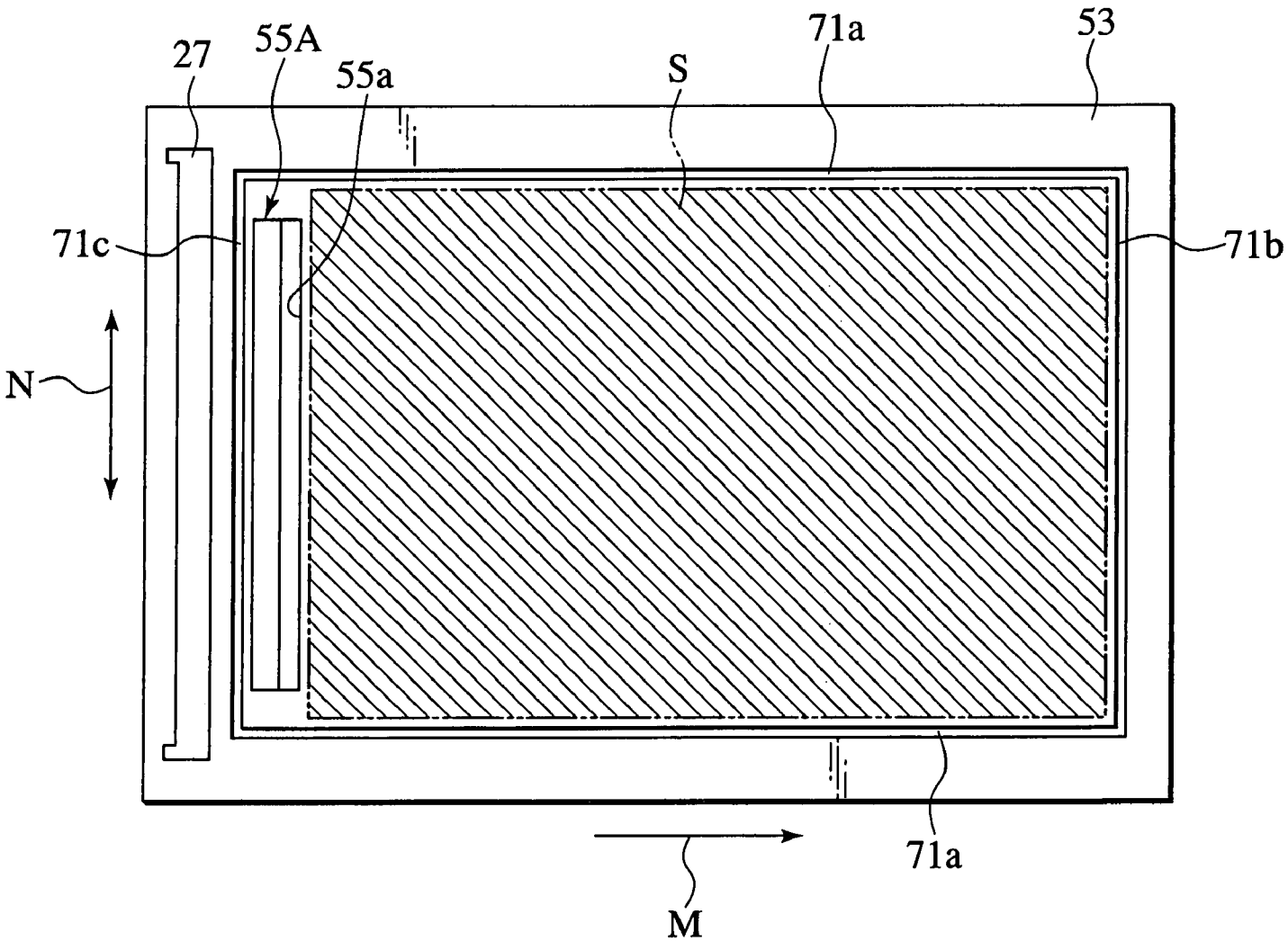
FIG. 5 is an expanded diagram of the outer peripheral wall of a printing drum to show the embodiment of the present invention.
Figure 7:
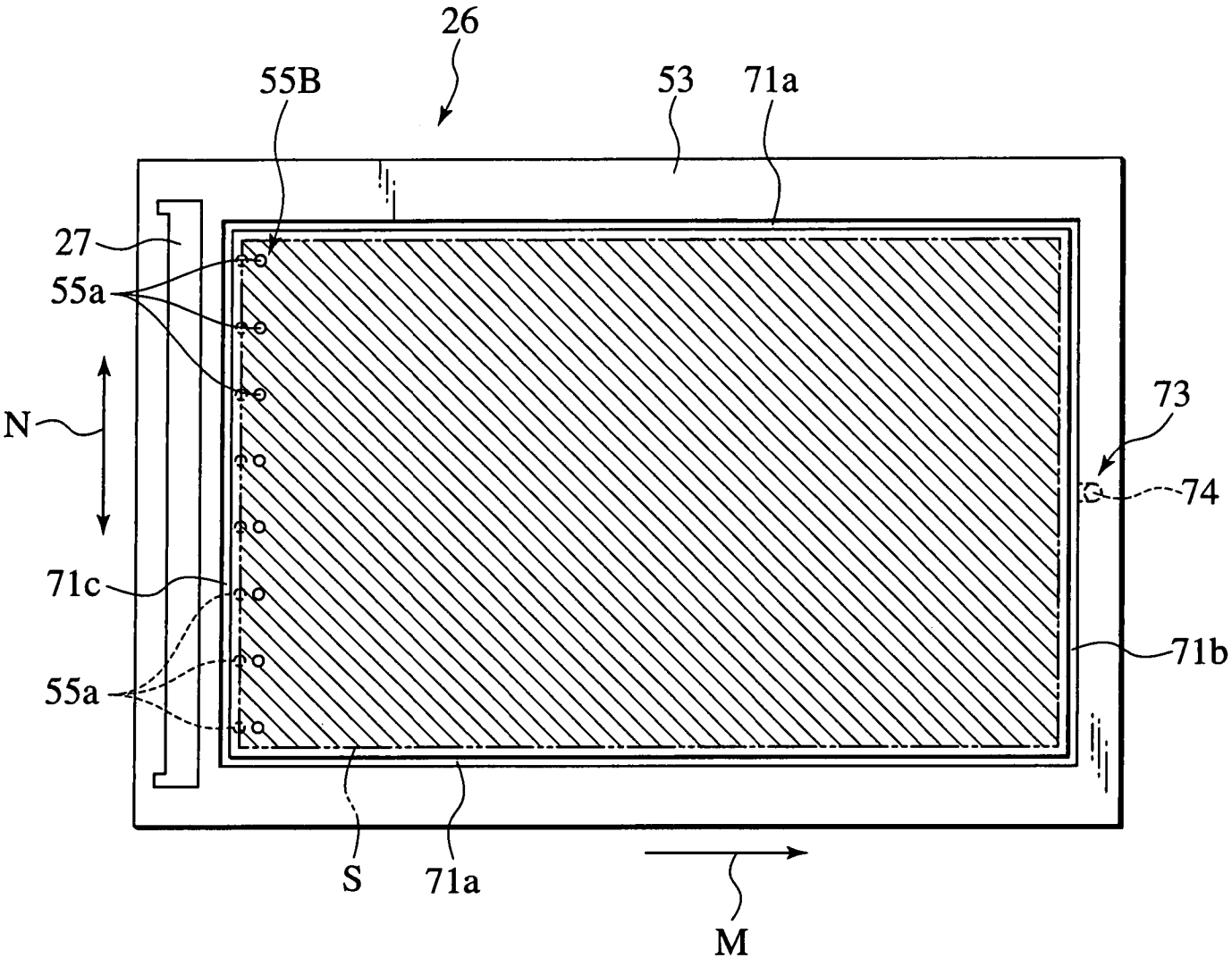
FIG. 7 is an expanded view of the outer peripheral wall of a printing drum to show the embodiment of the present invention.

As shown in FIGS. 5 and 7, the ink leakage preventing groove 71*a* is formed on the right and left sides out of the maximum printing area S in the direction N orthogonal to the printing direction M. The ink leakage preventing groove 71*b* is formed in a printed place downstream of the maximum printing area S so as to be extended in the direction N orthogonal to the printing direction M. The ink leakage preventing groove 71*c* is formed, in a printed place upstream of the ink supplying outlet 55*a* which is located upstream of the maximum printing area S, so as to be extended in the direction N orthogonal to the printing direction M. These ink leakage preventing grooves 71*a*, 71*b*, and 71*c* communicate with each other at the edges thereof. The ink leakage preventing groove 71*b* is formed in a way that a pipe fixing member 82 is arranged in the concave portion 81 of the outer peripheral wall 53.

The rotary joint 63 is also used for the ink supplying mechanism 54. Since the main shaft 50 is also used for the ink passage of the ink supplying mechanism 54, the main shaft 50 is constructed of a double pipe.

Figure 8:
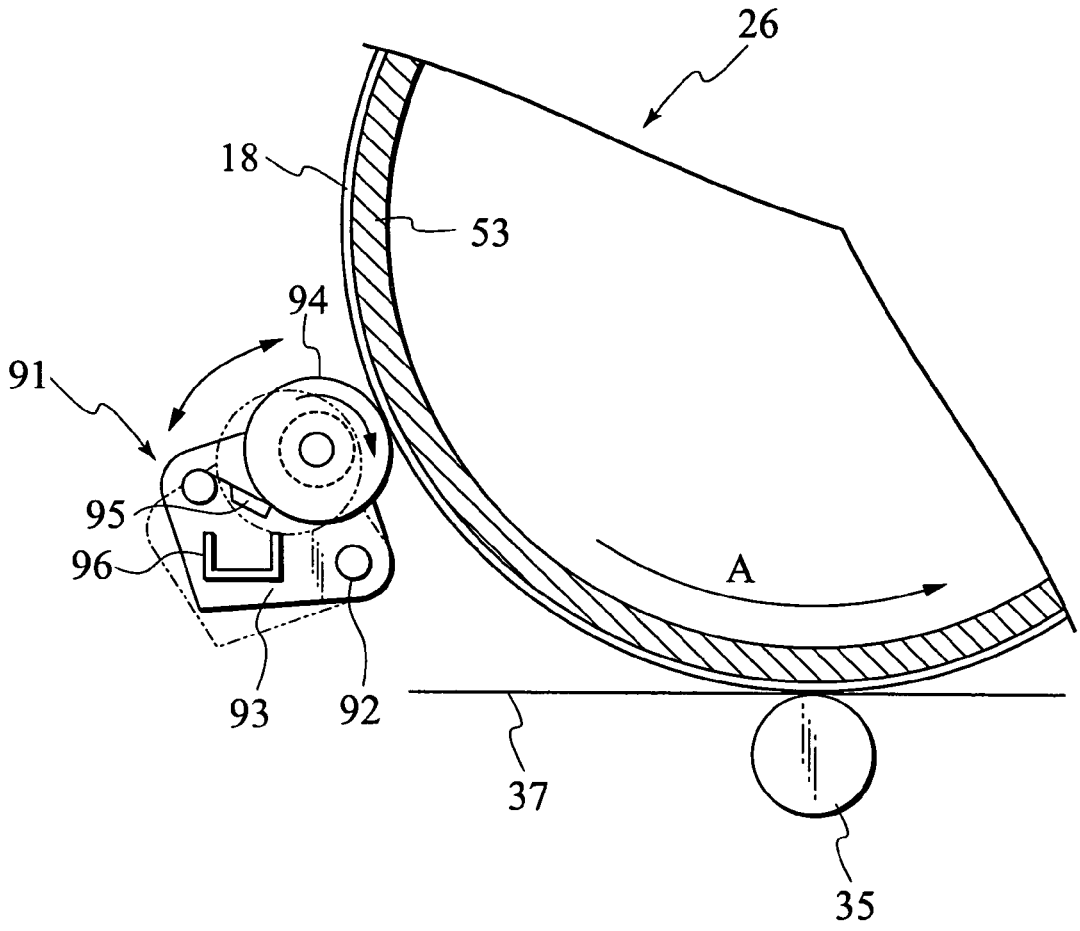
FIG. 8 is a magnified, block diagram of a pressing mechanism to show the embodiment.

In addition, the stencil printing machine is additionally provided with a pressing mechanism 91 for pressing the stencil paper 18 against the outer peripheral wall 53 of the printing drum 26, in the rotating place upstream of the place for the pressure roller 35 of the printing drum 26. As shown in FIG. 1 and FIG. 8, this pressing mechanism 91 comprises: the main shaft 92 which is supported by the main body H of the stencil printing machine; a movable plate 93 which is provided so as to be capable of being moved around the main shaft 92; a roller 94, functioning as a pressing body, which is supported by the movable plate 93 so as to be capable of being rotated. This pressing mechanism 91 is configured so as to be capable of changing the position between a pressing position (a position shown with solid lines in FIG. 8) in which the roller 94 presses the stencil paper 18 and a resting position (a position shown with an imaginary line in FIG. 8) in which the roller 94 separates from-the stencil paper 18. The surface of the roller 94 being pressed against the stencil paper 18 is made of a material which is not easily soaked with the ink 56, for example a fluorine contained resin material with water and oil repellent such as PFA and PTFE, or a silicone resin material.

Furthermore, the movable plate 93 is provided with a cleaning blade 95 and a container 96. The extremity of the cleaning blade 95 is caused to be in touch with the outer peripheral surface of the roller 94, and the container 96 is arranged in a place below this contacted place.

Next, operations of the stencil printing machine with the above described configuration will be explained briefly.

First, when a mode of making a stencil paper is chosen, the stencil making unit 2 loads the stencil paper 18 by the rotations of the platen roller 21 and the stencil loading roller 22. The stencil paper is prepared by perforating the stencil paper 18 according to heat sensitiveness in a way that a plurality of heat generators of the thermal print head 20 performs a selective operation of generating heat based on image date acquired by the original scanning unit 1. The prepared stencil paper 18 is cut at prescribed places by the stencil cutter 24, and accordingly is made into a stencil paper 18 in required measurements.

The printing unit 3 clamps the extremity of the stencil paper 18, which has been prepared by the stencil making unit 2, by the stencil clamping unit 27 of the printing drum 26. The printing unit 3 mounts the stencil paper 18 on the printing drum 26 through winding the stencil paper 18 around the outer peripheral surface of the printing drum 26 by causing the printing drum 26 to be rotated while in a state that the stencil paper is clamped.

Next, when a printing mode is chosen, the printing unit 3 causes the printing drum 26 to be driven and rotated, and concurrently causes the operation of the ink supplying mechanism 54 to be started. Then, the ink 56 is supplied from the ink supplying outlet 55*a* to the outer peripheral wall 53. The supplied ink 56 is held between the outer peripheral wall 53 and the stencil paper 18, and concurrently the pressure roller 35 is caused to provide displacement from the resting position to the pressing position.

The paper feeding unit 4 feeds a print sheet 37 between the printing drum 26 and the pressure roller 35, while being synchronized with the rotation of the printing drum 26. The fed print sheet 37 is pressed against the outer peripheral wall 53 of the printing drum 26 by the pressure roller 35, and concurrently is transferred by the rotation of the outer peripheral wall 53 of the printing drum 26. In other words, the print sheet 37 is transferred while being brought into contact with the stencil paper 18.

Figure 9:
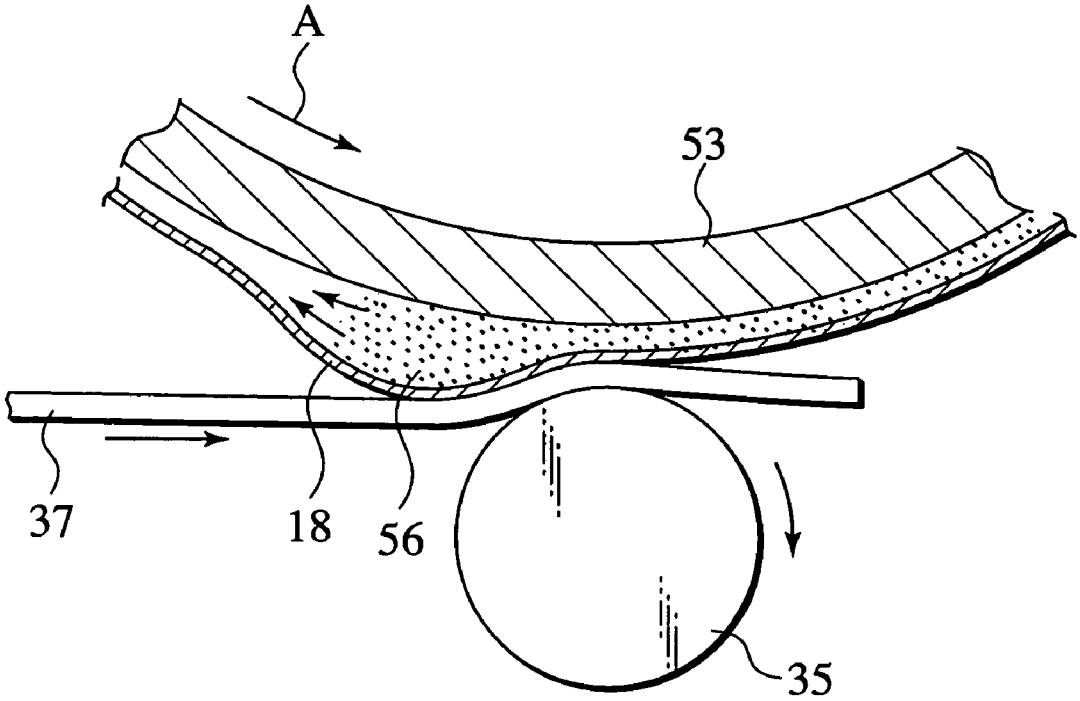
FIG. 9 is a partial, cross sectional view to describe a mechanism of dispersing ink, and to show the embodiment of the present invention.

In addition, in concurrence with the transferring of the print sheet 37, as shown in FIG. 9, ink 56 held between the outer peripheral wall 53 of the printing drum 26 and the stencil paper 18 is spread downstream in the printing direction M while being squeezed through in-between by the pressure caused by the pressure roller 35. Accordingly, the spread ink 56 transudes out of pores in the stencil paper 18, and is transferred onto the print sheet 37. In the above described way, an image is printed onto the print sheet 37 while in the process of being passing between the outer peripheral wall 53 of the printing drum 26 and the pressure roller 35. With regard to the print sheet 37 which has come out between the outer peripheral wall 53 of the printing drum 26 and the pressure roller 35, the extremity thereof is taken off the printing drum 26 by a sheet separator 44. The print sheet 37 which has been separated away from the printing drum 26 is discharged onto a paper receiving tray 46 through a transferring passage 45, and is laid thereon in a stack.

When the printing of the prescribed number of print sheets is completed, the outer peripheral wall 53 of the printing drum is caused to stop rotating, and concurrently the ink supplying mechanism 54 is caused to stop operating. By this, the supplying of ink 56 to the outer peripheral wall 53 is caused to stop. In addition, the pressure roller 35 is caused to return from the pressing position to the resting position, and is brought into a resting mode.

When a mode of discharging a stencil paper is chosen in order to do such as start to make a new stencil paper, the stencil clamping unit 27 of the printing drum 26 is caused to provide displacement to a place in which the clamping is released. Accordingly, the extremity of the stencil paper 18 which has been released from the state of being clamped is guided by the discharged stencil transferring mechanism 47 in correspondence with the rotation of the printing drum 26, and eventually the stencil paper is contained in the stencil disposal box 48.

Next, with regard to the above described operations, an explanation will be given of a case of using the pressing mechanism 91 in order to recover ink which remains in the inner surface of the stencil paper 18 to be discharged. When a mode of discharging a stencil paper is chosen, the roller 94 of the pressing mechanism 91 is caused to provide displacement to the pressing position. Accordingly, the ink recovering mechanism 73 is caused to operate, and concurrently the outer peripheral wall 53 of the printing drum 26 is caused to be rotated. By this, ink 56 between the stencil paper 18 and the outer peripheral wall 53 is squeezed through in-between, and accordingly is collected in a printed place downstream of the maximum printing area S. Eventually, this ink 56 is recovered by the ink recovering mechanism 73. A regular operation of discharging the stencil paper 18 is performed after the printing drum 26 is caused to make at least one rotation or more. In other words, a mere addition of the pressing mechanism 91 which presses the stencil paper 18 serves for the object of recovering the ink 56 which remains in the inner surface of the stencil paper 18. For this reason, the ink recovering mechanism can be configured of a simple constitution. In addition, ink 56 rarely remains staining in the pressing mechanism 91 which is not a usual route of ink circulation, although ink 56 remains staining in a usual route of ink circulation including the ink supplying unit 55A, the outer peripheral wall 53 and the ink recovering mechanism 73. As a consequence, the recovering of ink can be achieved with a high ratio of recycling ink.

Note that, the operation of squeezing through ink by the pressing mechanism 91, although performed prior to the operation of discharging a stencil paper 18 in this embodiment of the present invention, may be instead performed simultaneously with the operation of discharging the stencil paper. A range over which an operation of squeezing through ink is performed by the pressing mechanism 91, if performed at least between the ink supplying unit 55A and the ink leakage preventing groove 71*b,* serves for the object of the present invention. In addition, a larger pressure caused by the pressing mechanism 91 serves better for the object of the present invention, since the larger pressure is applied, the higher ratio of recovering ink can be obtained.

Next, an explanation will be given of a case that the pressing mechanism 91 is used in order to prevent an image on a printed sheet from being uneven. When there is a solid area thereon, a place with a high concentration is caused in the edge of a printed place downstream of the solid area, and an air bubble is noticed occurring between the stencil paper 18 and the outer peripheral wall 53 corresponding to the place where the high concentration has been caused. In addition, the correlation is found between the air bubble in the inner surface of the stencil paper 18 and the area with the high concentration on a printed sheet, and it is proved that the eliminating of the air bubble leads to the eliminating of the area with the high concentration. Based on this phenomenon and the like, in the course of a printing operation, a printing operation is performed by transferring the print sheet 37 between the pressure roller 35 and the outer peripheral wall 53 of the printing drum 26 through being pressed against, and brought into contact with, the pressure roller 35 and the outer peripheral wall 53 while pressing the stencil paper 18 against the outer peripheral 53 by the roller 94 of the pressing mechanism 91 which has been caused to provide displacement to the pressing position. Accordingly, an air bubble, if formed between the stencil paper 18 and the outer peripheral wall 53, is squeezed out by the roller 94 of the pressing mechanism 91. As a consequence, ink is transferred onto the print sheet 37 as if in a state that the air bubble did not exist in the inner surface of the stencil paper 18. As a consequence, an image unevenness, which an excessive amount of transferred ink would otherwise does not occur in the end of a printed place downstream of a solid area.

The roller 94 is caused to provide displacement to, and to stay always in, the pressing position in the course of a printing operation in this embodiment of the present invention. It should be noted, however, that, if a key for preventing a concentration unevenness is provided to a controller, the roller 94 which is instead caused to provide displacement to, and to stay in, the pressing position only when a mode of preventing the concentration unevenness is chosen also serves for the object of the present invention.

In this embodiment of the present invention, the stress cast on the stencil paper 18 can be reduced, since the pressing body of the pressing mechanism 91 is the roller 94 which is supported so as to be capable of being rotated. Accordingly, the stencil paper 18 can be surely prevented from being stretched. It should be noted that a pressing body which is formed, for example, of a blade also serves for the object of the present invention, if the pressing body can press the stencil paper 18. It is desirable that the width of the roller 94 of the pressing mechanism 91 should be larger than that of the maximum printing area S at least. With a configuration in this way, air bubbles which could occur anywhere in the maximum printing area S could be all eliminated.

In this embodiment of the present invention, ink 56 rarely conglutinates to the roller 94, since the pressing surface of the roller 94 is formed of a material which is not easily soaked with the ink 56. Accordingly, a printed sheet can be surely prevented from being stained in a way that the ink 56 which has conglutinated in the roller 94 would otherwise newly adheres to the printed sheet. In this embodiment of the present invention, too, ink 56 which has conglutinated in the roller 94 can be surely prevented from newly adhering to the stencil paper 18, since the cleaning blade 95 for scraping off ink 56 which has conglutinated in the roller 94 and the container 96 for containing the ink 56 which has been scarped off by the cleaning blade 95 are provided.

In this embodiment of the present invention, the pressing mechanism 91 is provided in addition to the pressure roller 35. However, the pressure roller 35 which is caused to concurrently perform a function done by the pressing mechanism 91 serves for the object of the present invention. This can make the configuration simpler, since no pressing body but the pressure roller 35 need not be added. Specific operations done by this is as follows. When an operation of discharging a stencil paper is chosen, the pressing of the stencil paper 18 by the pressure roller 35 causes the ink 35 to be collected in a printed place downstream of the maximum printing area S. In addition, while the printing is performed, the pressure roller 35 alternates between an operation of squeezing out an air bubble by pressing the stencil paper 18 and an operation of applying a printing pressure onto the print sheet 37 by the pressure roller 35.

Furthermore, immediately after a series of printing operations is completed, the ink is recovered by causing the outer peripheral wall 53 to be rotated while pressing the stencil paper 18 against the outer peripheral wall 53 by the pressing mechanism 91. Immediately after the printing is completed, the ink 56 in the inner surface of the stencil paper 18 has not yet been evaporated or reduced the volume thereof. Accordingly, the ratio of recycling ink can be improved. In other words, the ratio of recycling ink at this time is higher in comparison with the case that the ink is recovered at a time when a certain period of time has passed after the printing is completed. Incidentally, an operation of recovering the ink may be caused to be performed automatically at a time when a certain period of time has passed after the printing is completed.

Moreover, when the power supply is chosen to be off, the ink is recovered by causing the outer peripheral wall 53 to be rotated while pressing the stencil paper 18 against the outer peripheral wall 53 by the pressing mechanism 91. Ink 56 remaining in the inner surface of the stencil paper 18 could be securely prevented from disappearing through evaporation and the like, from a time when the power supply is turned off until a time when the power supply is turned on again.

In the embodiment, the ink recovering mechanism 73 for recovering ink which leak out of the maximum printing area S of the outer peripheral wall 53 is provided. Accordingly, an excessive amount of ink can be removed from the outer peripheral wall 53 of the printing drum 26, and concurrently can be recycled. In addition, ink which has been pooled in the grooves 71*a*, 71*b* and 71*c* for preventing ink leak can be recovered, a situation in which ink overflows from the grooves 71*a*, 71*b* and 71*c* for preventing ink leak can be avoided.

In the embodiment, the ink container 57 for supplying ink and the recovering container 79 for recovering ink are provided. For this reason, recovered ink may not necessarily be recycled.

In the embodiment, the filter 80 is placed in the middle of the fourth pipe 77 of the ink recovering mechanism 73, and thus ink 56 which is not contaminated with paper dust can be surely returned to the recovering container 79. This contributes to improving the quality of recycled ink. The ink filter 80, however, is not an essential item for recycling ink. An embodiment without the filter provided can be also acceptable.

In the embodiment, if control is made so as to cause the ink supplying mechanism 54 and ink recovering mechanism 73 to always operate while in a printing mode, ink is supplied uninterruptedly from the ink supplying unit 55A to the outer peripheral wall 53 while in a printing mode, and thus ink which flows from the outer peripheral wall 53 into the grooves 71*a*, 71*b* and 71*c* for preventing ink leak is always recovered. This prevents ink from remaining on the outer peripheral wall 53 as much as possible. In addition, an adequate amount of ink can be always held on the outer peripheral wall 53. Accordingly, even when a large quantity of printings is performed in succession, printed sheets which are prepared with a desired concentration of ink can be available.

Incidentally, the ink recovering mechanism 73 of the embodiment uses the grooves 71*a*, 71*b* and 71*c* for preventing ink leak as grooves for recovering ink. It should be noted, however, that ink recovering grooves may be constructed in a place other than the place in which the grooves 71*a*, 71*b* and 71*c* for preventing ink leak are arranged, preferably in a place outside the place in which the grooves 71*a*, 71*b* and 71*c* for preventing ink leak are arranged. Otherwise, only ink recovering grooves may be constructed instead of constructing the grooves 71*a*, 71*b* and 71*c* for preventing ink leak.

According to the embodiment, the grooves 71*a*, 71*b* and 71*c* for preventing ink leak are constructed to surround the entire outer periphery of the maximum printing area S of the outer peripheral wall 53, as if forming the sides of a rectangle. Even if the grooves are constructed only in a part of the outer periphery of the maximum printing area S, it serves for the object. In other words, the construction includes only the grooves 71*a* for preventing ink leak which are located in the sides, or only the groove 71*b* for preventing ink leak which is located in the end, or only the groove 71*c* for preventing ink leak which is located in the top, or only a combination of each two of the grooves for preventing ink leak. If the grooves 71*a* for preventing ink leak which are located in the sides are formed, ink leak from both sides of the printing drum 26 can be prevented. If the groove 71*b* which is located in the end is formed, ink leak from the end of the printing drum can be prevented. If the groove 71*c* which is located in the top is formed, ink leak from the top of the printing drum can be prevented.

Figure 10:
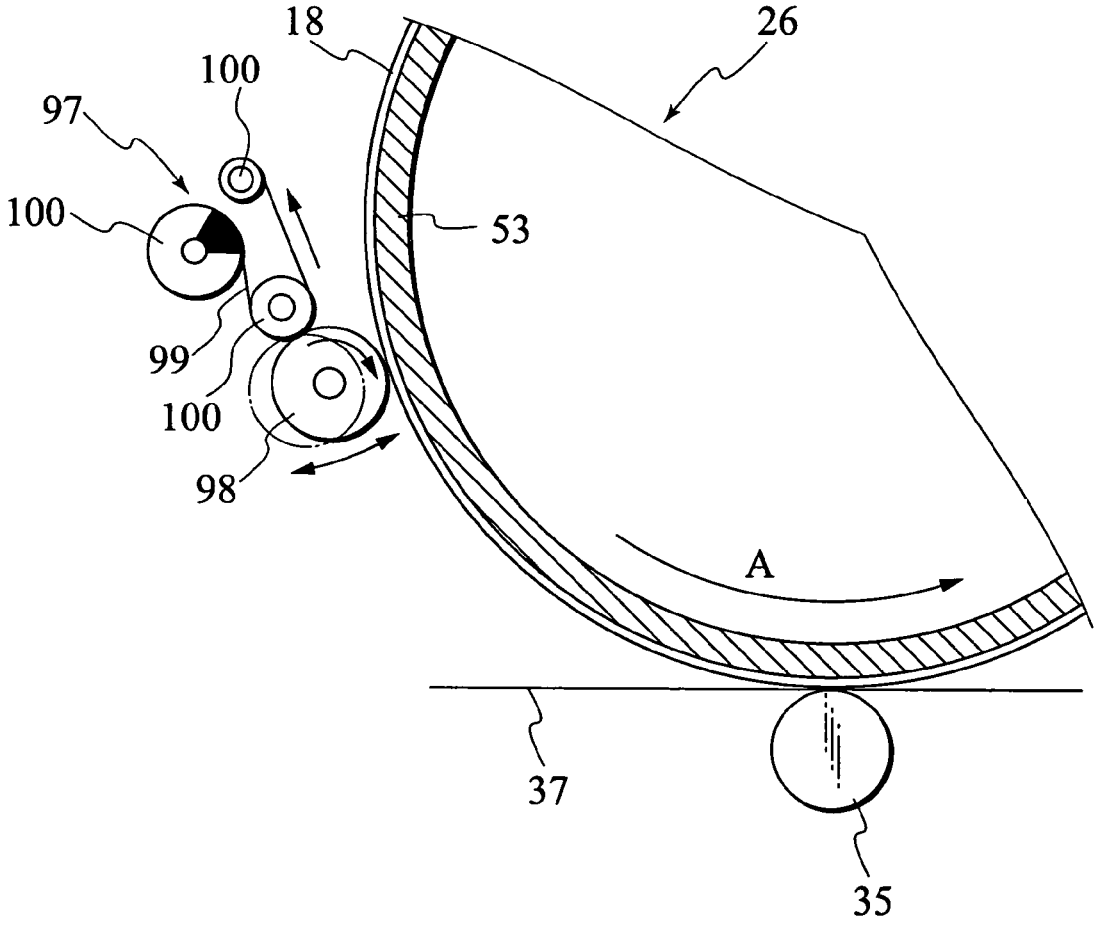
FIG. 10 is a magnified, block diagram to show a modification of the pressing mechanism according to the embodiment of the present invention.

FIG. 10 is a magnified block diagram to show a first modification of the pressing mechanism according to the embodiment of the present invention.

As shown in FIG. 10, a pressing mechanism 97 comprises: a roller 98 which is a pressing body; a cleaning web 99 which is in contact with the roller 98; and a transfer roller 100 for causing the cleaning web 99 to provide motion on a prescribed route. The roller 98 is provided so as to be capable of providing displacement between a pressing position in which the roller presses the stencil paper 18 (shown with a solid line in FIG. 8) and a resting position in which the roller separates away from the stencil paper 18 (shown with an imaginary line in FIG. 10).

The function and effect obtained by the pressing mechanism 91 according to the embodiment of the present invention can be also obtained by this pressing mechanism 97. In addition, since the cleaning web 99 is provided for wiping off ink 56 which has conglutinated in the roller 98, the ink 56 which would otherwise conglutinate in the roller 98 can be surely prevented from newly adhering to the stencil paper 18.

It should be noted that, although each of the pressing mechanism 91 and 97 is provided to a single place of the printing drum 26 respectively in the embodiment and the modification, each of the pressing mechanism 91 and 97 may be instead provided to a plurality of places of the printing drum 26 respectively in the embodiment and the modification.

In the embodiment and in the modification, the operation of squeezing through ink by the pressing mechanism is performed while an operation of discharging a stencil paper is carried out or while a printing operation is carried out. It should be noted, however, that, instead of this, the pressing of the stencil paper against the outer peripheral wall by the pressing mechanism in the course of an operation of mounting the stencil paper on the printing drum also serves for the object of the present invention. In this case, if ink is supplied and the stencil paper is pressed at the same time that the stencil paper is mounted on the printing drum, this causes ink which has been supplied to the ink supplying unit to be spread, and accordingly the ink dispersion becomes effective. In addition, what is called an initial printing operation can be eliminated.

Figure 11:
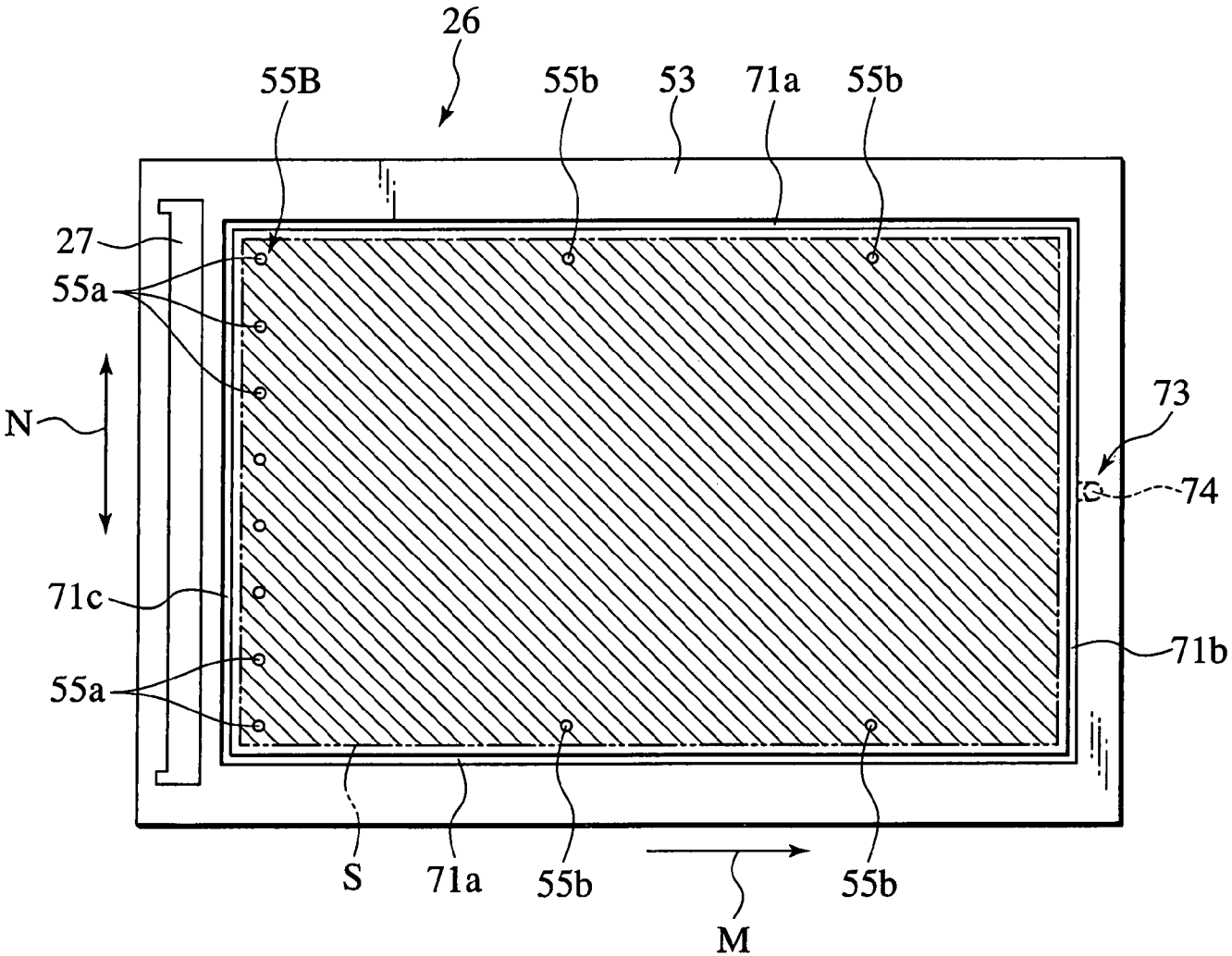
FIG. 11 is an expanded view of the outer peripheral wall of the printing drum to show a first modification of the embodiment of the present invention.

FIG. 11 is shows a second modification of the embodiment of the present invention, and is an expanded view of the printing drum.

In FIG. 11, as in the case of the embodiment, an ink supplying unit 55B includes ink supplying outlets 55*a*, which have a constitution similar to those used for the embodiment, and which is arranged in a most upstream position of the printing inside the maximum printing area S of the outer peripheral wall 53. In addition, the ink supplying unit 55B include ink supplying outlets 55*b* which are arranged at both the right and left side edges in the downstream position of the printing from the most upstream position of the printing inside the maximum printing area S, which is located on the outer peripheral wall 53 of the printing drum 26.

Incidentally, since other constitutions are the same as those used for the above described embodiment, detailed description is omitted in order to avoid repeated description.

According to the second modification, while ink is being squeezed through downstream by the pressure roller 35, part of the ink is squeezed out of both right and left side edges of the maximum printing area S. In some cases, as the ink is squeezed through downstream of the maximum printing area S further and further, an amount of ink goes insufficient in both right and left side edges. For this reason, ink is configured to be additionally supplied from the vicinity of both edges downstream. Accordingly, in no case does ink go insufficient in the vicinity of both edges downstream. As a result, unevenness of print concentration in the direction N orthogonal to the printing direction M can be surely avoided.

Figure 12:
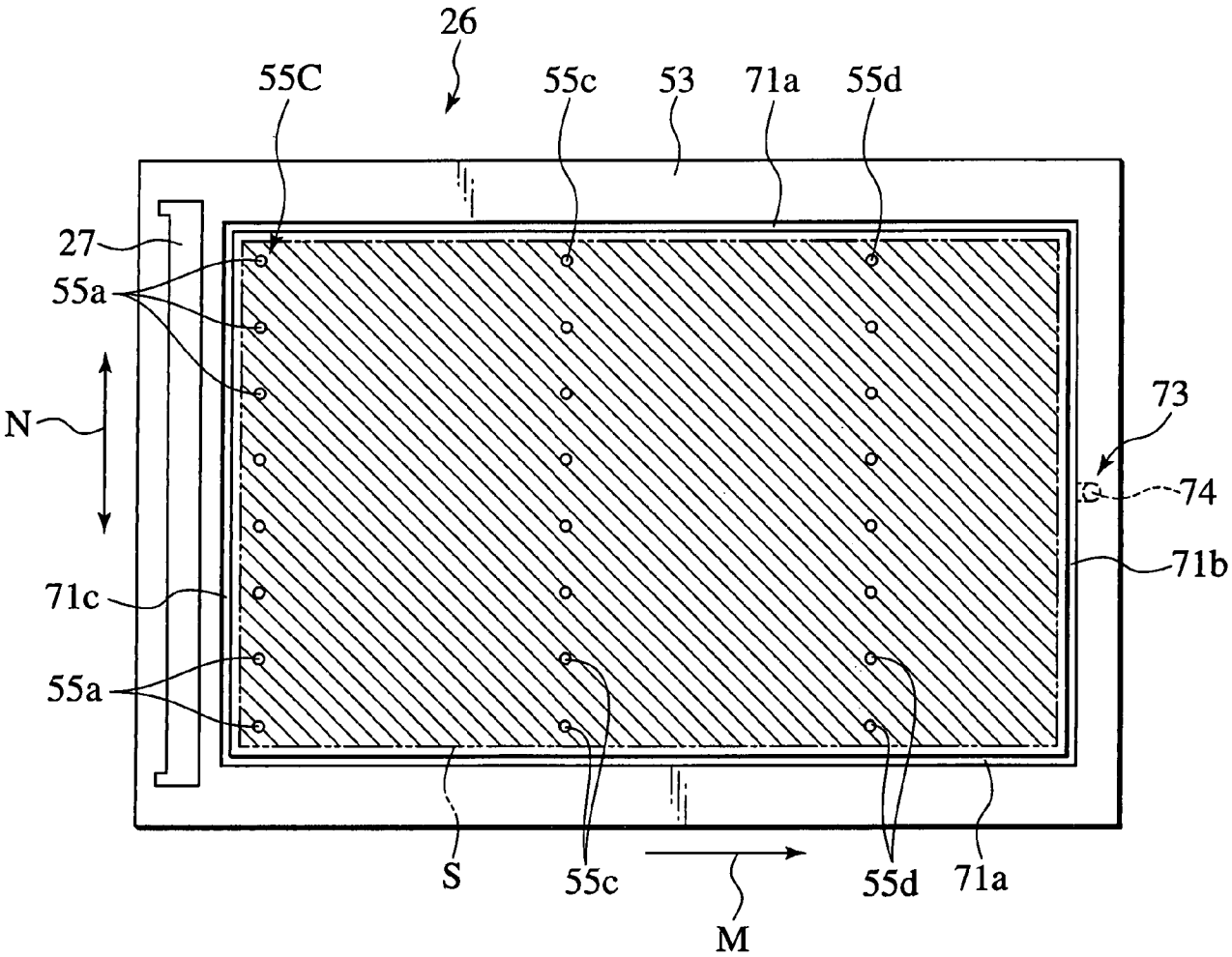
FIG. 12 is an expanded view of the outer peripheral wall of the printing drum to show a second modification of the embodiment of the present invention.

FIG. 12 shows a third modification of the embodiment of the present invention, and is an expanded view of the outer peripheral wall of the printing drum.

As shown in FIG. 12, an ink supplying unit 55C includes ink supplying outlets 55*a* in the most upstream portion of the printing, which is obtained by dividing the maximum printing area S in the outer peripheral wall 53 of the printing drum 26 into three blocks in the direction downstream of the printing, and which responds to a place similar to that of the above described embodiment. The ink supplying unit 55C also include ink supplying outlets 55*c* and 55*d* in the upstream position of the respective blocks which are located downstream of the most upstream block. The ink supplying outlets 55*a*, 55*c* and 55*d* which are arranged in the respective three blocks are constructed to be open in intervals equal to one another in the direction N orthogonal to the printing direction M in the outer peripheral wall 53.

In the third modification, if the ink supplying outlets 55*a*, 55*c* and 55*d*, which are located in the respective three blocks, supply an amount of ink which is needed for use in each block instead of for use in the entire printing area, it serves for the object. For this reason, a lump of ink, if formed between the stencil paper 18 and the outer peripheral wall 53, could be minimized while the ink is squeezed through by the pressure roller 35. As a consequence, load cast on the stencil paper 18 could be reduced, and thus the durability of a stencil paper 18 against repeated use for printing could be improved.

What is claimed is:

1. A stencil printing machine, comprising:

a rotatable printing drum including an outer peripheral wall of ink impermeable member, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum.

2. The stencil printing machine according to claim 1, wherein the pressing mechanism presses the stencil paper against the outer peripheral wall while an operation of discharging the stencil paper is performed.

3. The stencil printing machine according to claim 1, wherein the pressing mechanism presses the stencil paper against the outer peripheral wall while a printing operation is performed.

4. The stencil printing machine according to claim 1, wherein the pressing mechanism presses the stencil paper against outer peripheral wall while an operation of mounting a stencil paper on the printing drum is performed.

5. The stencil printing machine according to claim 1, wherein a pressing body of the pressing mechanism comprises a second roller.

6. The stencil printing machine according to claim 5, wherein a pressing surface of the pressing body is formed of material which is not easily soaked with ink.

7. The stencil printing machine according to claim 5, the machine further comprising:

a support for rotatably supporting said second roller.

8. The stencil printing machine according to claim 1, wherein the ink supplying unit is configured to supply ink between the stencil paper and the surface of the outer peripheral wall from the inside of the printing drum without exposing the ink to the atmosphere.

9. The stencil printing machine according to claim 1, wherein the ink supplying mechanism includes a conduit configured to supply ink to the ink supplying unit from the inside of the printing drum without exposing the ink to the atmosphere.

10. An ink recovering method used for a stencil printing machine, the stencil printing machine which is provided with:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum, the ink recovering method comprising:

causing the outer peripheral wall to be rotated while the stencil paper is pressed against the outer peripheral wall by the pressing mechanism to move ink between the stencil paper and the outer peripheral wall; and recovering ink, which has flown out of the maximum printing area of the outer peripheral wall, by the ink recovering mechanism.

11. An ink recovering method used for a stencil printing machine, the stencil printing machine which is provided with:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum, the ink recovering method comprising:

causing the outer peripheral wall to be rotated while the stencil paper is pressed against the outer peripheral wall by the pressing mechanism to move ink between the stencil paper and the outer peripheral wall;

recovering ink, which has flown out of the maximum printing area of the outer peripheral wall, by the ink recovering mechanism;

rotating the outer peripheral wall while using the pressing mechanism to press the stencil paper against the outer peripheral wall when an operation of discharging the stencil paper is selected;

mounting the stencil paper on the printing drum while supplying ink from the ink supplying unit; and concurrently using the pressing mechanism to press the stencil paper against the outer peripheral wall.

12. An ink recovering method used for a stencil printing machine, the stencil printing machine which is provided with:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum, the ink recovering method comprising:

causing the outer peripheral wall to be rotated while the stencil paper is pressed against the outer peripheral wall by the pressing mechanism to move ink between the stencil paper and the outer peripheral wall;

recovering ink, which has flown out of the maximum printing area of the outer peripheral wall, by the ink recovering mechanism;

causing the outer peripheral wall to rotate while the stencil paper is pressed against the outer peripheral wall by the pressing mechanism when the printing operations are completed;

mounting the stencil paper on the printing drum while supplying ink from the ink supplying unit; and concurrently using the pressing mechanism to press the stencil paper against the outer peripheral wall.

13. An ink recovering method used for a stencil printing machine, the stencil printing machine which is provided with:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum, the ink recovering method comprising:

causing the outer peripheral wall to be rotated while the stencil paper is pressed against the outer peripheral wall by the pressing mechanism to move ink between the stencil paper and the outer peripheral wall;

recovering ink, which has flown out of the maximum printing area of the outer peripheral wall, by the ink recovering mechanism;

causing the outer peripheral wall to rotate while the stencil paper is pressed against the outer peripheral wall by the pressing mechanism when the power supply is selected to be off;

mounting the stencil paper on the printing drum while supplying ink from the ink supplying unit;

and concurrently using the pressing mechanism to press the stencil paper against the outer peripheral wall.

14. A stencil printing machine comprising:

a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall of the printer drum;

an ink recovering mechanism configured to recover ink which has flown out of a maximum printing area of the outer peripheral wall of the printing drum; and a pressing mechanism configured to press the stencil paper against the outer peripheral wall of the printing drum, wherein, in the course of a printing operation, the printing operation is performed in a state that the stencil paper is pressed against the outer peripheral wall by the pressing mechanism.

15. An ink adapting method of a stencil printing machine, wherein the stencil printing machine is provided with a rotatable printing drum including an outer peripheral wall of ink impermeable material, wherein a stencil paper is mounted on the surface of the outer peripheral wall;

an ink supplying mechanism including an ink supplying unit in the outer peripheral wall of the printing drum, configured to supply ink from the ink supplying unit to the surface of the outer peripheral wall;

a pressure roller configured to press a fed print medium against the outer peripheral wall;

an ink recovering mechanism configured to recover ink which has flown out of a maximum printing area of the outer peripheral wall of the printing drum; and a pressing mechanism configured to press the stencil paper against the outer peripheral wall of the printing drum, the method comprising:

mounting the stencil paper on the printing drum while supplying ink from the ink supplying unit, and concurrently using the pressing mechanism to press the stencil paper against the outer peripheral wall.

* * * * *